US007805953B2

(12) United States Patent
Jensen

(10) Patent No.: US 7,805,953 B2
(45) Date of Patent: Oct. 5, 2010

(54) PREFILTER SYSTEM FOR HEAT TRANSFER UNIT AND METHOD

(76) Inventor: Tim Allan Nygaard Jensen, 2525 Millington Dr., Plano, TX (US) 75093

( * ) Notice: Subject to any disclaimer, the term of this patent is extended or adjusted under 35 U.S.C. 154(b) by 619 days.

(21) Appl. No.: 11/463,037

(22) Filed: Aug. 8, 2006

(65) Prior Publication Data

US 2008/0034776 A1 Feb. 14, 2008

Related U.S. Application Data

(60) Provisional application No. 60/706,585, filed on Aug. 9, 2005.

(51) Int. Cl.
*F25D 17/06* (2006.01)

(52) U.S. Cl. ..... 62/91; 62/305; 62/506

(58) Field of Classification Search ..... 62/92, 62/121, 123, 171, 183, 305, 419, 467, 506, 62/91; 454/228, 229, 230, 236, 239, 241, 454/249; 261/98, 111; 210/503, 505; 96/8, 96/10; 340/607, 626

See application file for complete search history.

(56) References Cited

U.S. PATENT DOCUMENTS

| | | | | |
|---|---|---|---|---|
| 2,142,423 | A | 1/1939 | Timmis | |
| 2,231,856 | A | 2/1941 | Wetter | |
| 2,278,242 | A | 3/1942 | Chapman | |
| 2,493,141 | A * | 1/1950 | Henney | 62/305 |
| 2,655,795 | A | 1/1952 | Dyer | |
| 2,995,018 | A | 2/1959 | Dempsey, Jr. | |
| 3,108,451 | A | 10/1963 | Clifford | |
| 3,182,718 | A | 5/1965 | Goettl | |
| 3,233,422 | A * | 2/1966 | Kobrin | 62/155 |
| 3,427,005 | A | 2/1969 | Kuykendall | |
| 3,613,392 | A | 10/1971 | Tucci | |
| 3,859,818 | A | 1/1975 | Goettl | |
| 3,872,684 | A | 3/1975 | Scott | |
| 3,984,995 | A | 10/1976 | Starr et al. | |

(Continued)

FOREIGN PATENT DOCUMENTS

JP 11-118326 A * 4/1999

(Continued)

OTHER PUBLICATIONS

Abstract to JP 11-118326 A to Ishiguro et al.*

(Continued)

*Primary Examiner*—Mohammad M Ali
(74) *Attorney, Agent, or Firm*—Grady K. Bergen; Griggs Bergen LLP

(57) ABSTRACT

A method of transferring heat is accomplished by providing a heat exchanger unit that is at least partially air cooled. The heat exchanger unit has an evaporator, condenser, compressor and a fan for forcing air over an exteriorly located heat exchange surface of the condenser. A fiberglass filter element is positioned adjacent to the heat exchange surface of the condenser for capturing at least one of grease, debris and other contaminants that are not entrained within any liquid cooling fluid that would otherwise contact the heat exchange surface. The filter element is allowed to capture the at least one of grease, debris and other contaminants prior to contact with the heat exchange surface of the condenser.

20 Claims, 7 Drawing Sheets

U.S. PATENT DOCUMENTS

| | | | | |
|---|---|---|---|---|
| 4,028,906 | A | 6/1977 | Gingold et al. | |
| 4,066,118 | A | 1/1978 | Goettl | |
| 4,067,205 | A * | 1/1978 | Mayhue | 62/279 |
| 4,170,117 | A | 10/1979 | Faxon | |
| 4,182,131 | A | 1/1980 | Marshall et al. | |
| 4,199,955 | A | 4/1980 | Jonsson | |
| 4,204,409 | A | 5/1980 | Satama | |
| 4,212,172 | A | 7/1980 | Manno | |
| 4,240,265 | A | 12/1980 | Faxon | |
| 4,266,406 | A | 5/1981 | Ellis | |
| 4,274,266 | A | 6/1981 | Shires | |
| 4,290,274 | A | 9/1981 | Essex | |
| 4,353,219 | A | 10/1982 | Patrick, Jr. | |
| 4,365,483 | A | 12/1982 | Binger | |
| 4,373,346 | A | 2/1983 | Hebert et al. | |
| RE31,360 | E * | 8/1983 | Manno | 227/146 |
| 4,505,327 | A | 3/1985 | Angle et al. | |
| 4,559,789 | A | 12/1985 | Riek | |
| 4,612,778 | A | 9/1986 | Medrano | |
| 4,672,817 | A | 6/1987 | Croce | |
| 4,685,308 | A | 8/1987 | Welker et al. | |
| 4,730,462 | A | 3/1988 | Rogers | |
| 4,918,943 | A | 4/1990 | Faust | |
| 4,938,035 | A | 7/1990 | Dinh | |
| 4,939,907 | A | 7/1990 | Taylor | |
| 5,003,789 | A | 4/1991 | Gaona et al. | |
| 5,117,644 | A | 6/1992 | Fought | |
| 5,285,651 | A | 2/1994 | Marine | |
| 5,297,397 | A | 3/1994 | Pointer | |
| 5,351,035 | A * | 9/1994 | Chrisco | 340/607 |
| 5,476,526 | A * | 12/1995 | Attermeyer | 55/496 |
| 5,553,463 | A | 9/1996 | Pointer | |
| 5,605,052 | A | 2/1997 | Middleton et al. | |
| 5,695,117 | A | 12/1997 | Sizemore et al. | |
| 5,701,708 | A | 12/1997 | Taraba et al. | |
| 5,701,748 | A | 12/1997 | Phelps et al. | |
| 5,702,130 | A | 12/1997 | Jostein | |
| 5,809,800 | A * | 9/1998 | Deal | 62/507 |
| 6,048,816 | A | 4/2000 | Brown et al. | |
| 6,237,359 | B1 | 5/2001 | Hebert | |
| 6,253,565 | B1 | 7/2001 | Arledge | |
| 6,463,751 | B1 | 10/2002 | Teller | |
| 6,490,879 | B1 * | 12/2002 | Lloyd et al. | 62/291 |
| 6,574,975 | B2 | 6/2003 | Bourne et al. | |
| 6,579,350 | B2 * | 6/2003 | Doherty | 96/67 |
| 6,579,396 | B2 * | 6/2003 | Erb, Jr. | 156/166 |
| 6,609,386 | B1 | 8/2003 | Schmoldt | |
| 6,619,059 | B1 * | 9/2003 | Johnson, Sr. | 62/171 |
| 6,737,277 | B1 * | 5/2004 | Kang et al. | 436/514 |
| 6,793,715 | B1 | 9/2004 | Sandberg | |
| 6,871,507 | B1 | 3/2005 | Goldsmith | |
| 6,925,819 | B2 * | 8/2005 | Ingley et al. | 62/89 |
| 2002/0073720 | A1 | 6/2002 | Bourne et al. | |
| 2003/0213253 | A1 | 11/2003 | James | |
| 2004/0129014 | A1 | 7/2004 | Richman et al. | |
| 2004/0211208 | A1 | 10/2004 | Permetti | |
| 2006/0116791 | A1 | 6/2006 | Ravula et al. | |

FOREIGN PATENT DOCUMENTS

JP 2002-282706 A * 10/2002

OTHER PUBLICATIONS

Translation of JP 11-118326 A to Ishiguro et al.*
Premier Industries, Inc., "Precoolers", pp. 1-2, No Date.
Web pages from http://www.permatron.com/Media/Polypro.html, printed Aug. 2, 2005, pp. 1-3.
Permatron web page, Dry Cooler Screens/Inlet Air Filters, accessed Aug. 4, 2006, p. 1.
Permatron web page, Metal Grease Baffle Filters Available in Three Models, accessed Aug. 4, 2006, p. 1.
Permatron web page, Primo Pizza—Equipment Protection Air Filter Application Walk-In Cooler Condensing Unit, accessed Aug. 4, 2006, p. 1.
Spec-Air, Pre-Cooler—Pre-Refrigerant Evaporative Cooler Product Information Sheet, pp. 1-4, no date listed.
Metal Form Manufacturing Company Inc., webpages from htttp://www.mfmca.com/precooler_kits.html; copyright notice date 2007.
Integrated Comfort, Inc., webpage from http://www.dualcool.net, no date listed, printed Feb. 16, 2010.
Mark Snyder Electric, webpage from http://www.marksnyderelectric.com/corecool.shtml, no date listed, printed Feb. 16, 2010.
Cool-N-Save Commercial AC Pre-Cooler, webpage from http://acprecooling.com/how_does_it_work.html, no date listed, printed Feb. 15, 2010.
Cool Edge, webpage from http://www.cooledge-precoolers.com/precoolers.htm, copyright notice date 2007.
Cool Edge CELdek Standard Dimensions, webpages from http://www.cooledge-precoolers.com/celdek.htm, copyright notice date 2007.
ACMister for Wire Frame Compressors, webpages from http://www.acmister.com/index.php? page=shop.product_details &product_id=2&category_, copyright notice date 2001-2010.
Cool-N-Save, webpage from http://coolnsave.com/, no date.
Kool-Plus, webpage from http://kool-plus.com/, no date.
Quality Screen Co. LLC webpages from http://www.qualitywindowscreen.com/window-screen.html, Copyright 2003-2008.

* cited by examiner

PREFILTER SYSTEM FOR HEAT TRANSFER UNIT AND METHOD

This application claims the benefit of U.S. Provisional Application Ser. No. 60/706,585, filed Aug. 9, 2005, entitled "Method of Transferring Heat and Heat Transfer System."

TECHNICAL FIELD

The invention relates to heat transfer systems and methods of transferring heat.

BACKGROUND

Most air conditioners in use today reject heat through air-cooled condensers. These units include the typical residential split-system air conditioner with the condensing unit outdoors and packaged rooftop units that are often used on commercial buildings.

The cold refrigerant within the air conditioning unit absorbs heat from indoors through the evaporator. The refrigerant evaporates or boils, capturing a great deal of energy as it absorbs heat and cools the airflow within the home or building. The warm refrigerant vapor is then returned to the compressor where the pressure is raised significantly, causing a commensurate increase in refrigerant temperature. The high pressure, hot vapor is then passed to the condenser coils. The refrigerant vapor temperature is typically 30 F higher than the ambient or outdoor temperature. Outdoor air is forced over the coils to reject or remove the heat that was absorbed back in the evaporator coil plus the energy that was added through compression. In the heat rejection process, the vapor condenses into a high pressure liquid refrigerant. The warm liquid refrigerant is then carried to an expansion valve near the evaporator that rapidly drops the refrigerant pressure with a commensurate drop in temperature. The refrigerant then enters the evaporator, and the cycle repeats.

The energy that is rejected or removed from the condenser is equal to the energy that is absorbed as heat in the evaporator plus the energy that is added as work by the compressor in raising the pressure of the refrigerant. Or put another way, the cooling capacity of the evaporator, and indeed the amount of compressor work needed is directly related to the heat or energy that can be rejected through the condenser coil. It is therefore beneficial that the heat transfer through the condenser be maintained at the highest possible level. The heat transfer rate from the condenser coil is modeled by the well-known convection rate equation:

$$Q=h*A*(T_{refg}-T_{air}) \quad (1)$$

Where: Q=heat transfer rate [Btu/hr or Watts]

h=convection heat transfer coefficient [Btu/(hr*ft$^2$*F) or W/(m$^2$*C)]

A=coil surface area [ft$^2$ or m$^2$]

$T_{refg}$=refrigerant temperature [F or C]

$T_{air}$=air temperature [F or C]

The optimal air conditioning performance is achieved by maintaining a high heat transfer rate, or heat rejection, Q, through the condenser.

One way to increase Q is to increase $T_{refg}$. This can only be achieved by increasing the compressor output pressure. However, the compressor work or energy input must be increased to increase head pressure and $T_{refg}$, which ultimately costs more work energy than cooling gained. The air conditioner control system does increase pressure in response to higher outdoor temperatures ($T_{air}$) and, as described below, in response to blockage of the coil or decreased convection coefficient.

There are two practical approaches for maximizing the air conditioner's efficiency by maintaining the highest possible heat rejection, Q. First, one can insure that the effective coil area, A, and the nominal convection coefficient, h, are not reduced or compromised. It is also possible to increase h by increasing the air velocity across the coil. This is only practical by changing the condenser fan(s) or increasing its speed. Increasing the speed will increase the brake horsepower of the fan motor. Second, one can reduce the air temperature, $T_{air}$, entering the condenser coil.

Both approaches, maintaining A and h and decreasing $T_{air}$ are addressed by the present invention and are discussed below.

BRIEF DESCRIPTION OF THE DRAWINGS

For a more complete understanding of the present invention, reference is now made to the following descriptions taken in conjunction with the accompanying figures, in which.

DETAILED DESCRIPTION

Figure 1:
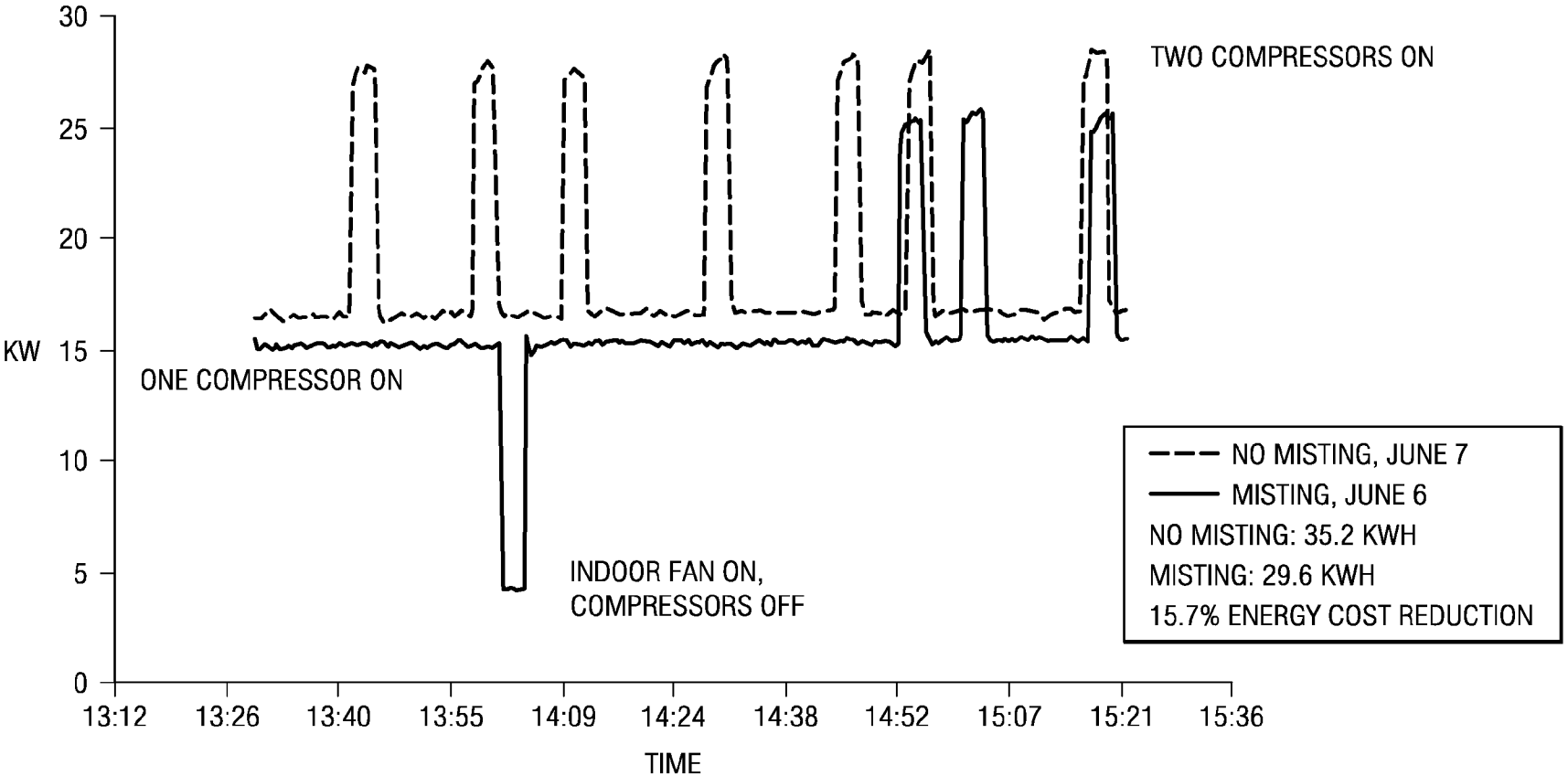
FIG. 1 is a plot of the power consumption for an air conditioning unit over time on days were the air conditioning was employed with misters and without.

The coil surface area, A, is set by the manufacturer and is generally slightly oversized for the design load. While this sets the maximum coil area, A, it should be noted that the effective surface area can be reduced by debris and contaminants blocking a portion of the coil. If there is significant blockage, the air conditioning unit responds by making the compressor work harder to raise the pressure of the refrigerant further, effectively increasing the refrigerant temperature, $T_{refg}$. If the contaminant is grease from a kitchen exhaust fan, which are oftentimes located on rooftops near the air conditioning units, or something similar, the blockage may not simply decrease the effective coil surface area, but the convection coefficient, h, may also be reduced due to the greasy film that will coat the coil fins.

Engineers and air conditioning manufacturers have failed to recognize the extent to which the air conditioner's performance can be compromised by kitchen grease and other contaminants that may come in contact with and coat the condenser coil surfaces.

Keeping a residential condenser coil clean may require removing a protective wireguard and then pressure washing and brushing the fins of the coil. A commercial unit generally has a larger coil than those used for residential purposes and can be in a greasy or dirty and less accessible environment. Cleaning is very often neglected by less conscientious maintenance crews. Unfortunately, there have not been any devices used for capturing kitchen grease and other aerosol contaminants, such as paint, that would be effective in protecting the condenser coil surfaces from being coated with these substances.

A study was conducted on a 15-ton Lennox rooftop commercial air conditioning unit on a restaurant. The air conditioning unit initially appeared to perform at less than the rated cooling capacity. Although the restaurant had only been in operation about ten weeks, all units had a readily apparent layer of grease on the condenser coils. This was also true of a 10-ton and a 20-ton unit that were also present on the rooftop. The roof temperature was 103 F on the afternoon the day data was taken. Based on the power consumption, which was about 16% higher and the cooling capacity which was about 7% lower than expected, the 15-ton unit was operating as though the roof temperature was 122 F.

The control system was reacting to the reduced A*h by increasing the compressor pressure and $T_{refg}$. Degreasing and washing of the coil would increase the A*h. This is time-consuming and difficult work on a hot roof. Further, the effect of such degreasing and washing operations would only be temporary.

The present invention thus provides a more effective means to capture grease and other debris and increases the effectiveness of evaporative precoolers.

The second method to improve the heat rejection, Q, is to reduce the entering air temperature to the condenser coil, $T_{air}$. There are many inventions that address ways to accomplish this. One effective means is to adiabatically cool the ambient airflow by misting or evaporating a nominal amount of water into the airflow. Applicant's prior U.S. Pat. Nos. 6,823,684 and 7,021,070, issued Nov. 30, 2004 and Apr. 4, 2006, respectively, and presently pending U.S. patent application Ser. No. 11/043,763, filed Jan. 26, 2005, which are hereinafter collectively referred to as "Jensen" and which are hereby incorporated by reference in their entireties, each disclose evaporative precoolers that work well and not only increase the cooling capacity, but also decrease power consumption, improving the operating efficiency by as much as 30 to 40%.

Use of the systems, such as those disclosed in Applicant's above-referenced patents and patent application, in a residential system has shown that the design has very little water runoff, and achieves about 60 to 70% saturation effectiveness. Where "saturation effectiveness" is defined as the percentage of increase in relative humidity, r.h., divided by the maximum possible relative humidity increase or:

$$\text{Saturation Effectiveness}=(\text{final } r.h.-\text{initial } r.h.)/(100\% \; r.h.-\text{intial } r.h.) \quad (2)$$

In the harsher environment of a commercial rooftop or other areas, especially a restaurant rooftop, additional improvements may be needed. Initial prototype testing had resulted in a saturation effectiveness of only about 30%, yielding a 5% drop in power consumption. Adding mister posts increased the saturation effectiveness to roughly 45 or 50%, yielding a 9% drop in power. The primary cause of the drop in saturation effectiveness was due to windy conditions and resulting turbulence on the roof. Much of the water mist was carried away from the rooftop unit and never made it to the condenser coil. This results in lost efficiency savings, wasted water, and additional water runoff. Further testing during the month of June achieved saturation effectiveness of almost 70% which yielded energy savings of 16%. FIG. 1 below presents the power consumed in kW from the misting on Jun. 6, 2005 compared to the same time period without misting on Jun. 7, 2005, with temperatures being generally the same on both days. Note that the misting increases the air conditioning unit's cooling capacity allowing the first stage compressor to meet the load for longer periods than without misting. In other words, the second stage compressor must come on more frequently without misting.

The present invention provides a means for capturing grease, debris, and other contaminants that may come into contact with the condenser coils, thus reducing their effectiveness. Additionally, the present invention increases the effectiveness of evaporative precoolers. The best efficiencies are gained by using the two components together, but there may by situations where using the condenser prefilter alone is warranted, as is described more fully below.

The air conditioner performance may be improved by utilizing a filter for the condenser coil. A rooftop unit typically has one end and one or two adjoining sides taken up by the condenser coil. Air is drawn in through the coil and usually exhausted upward by one or more condenser fans. This arrangement allows the condenser coil to be surrounded or wrapped with a filter or screen which captures the majority of any debris or contaminant that could otherwise attach to or block the condenser coil.

The pressure drop or loss through a coil is typically between 50 and 100 Pa (0.10" and 0.20" $H_2O$). Selecting an appropriate filter involves a trade-off between the low pressure drop of an inexpensive 1" fiberglass filter and the high resistance of a thicker, denser filter. Filters with a MERV rating of 1 to 12 may be used. A 1" fiberglass filter with a MERV rating of 1 to 4 will catch almost all of the relatively large grease droplets and most debris. It will typically have a pressure loss of 15 to 25 Pa (0.03" to 0.05") at a face velocity of 1.00 to 1.25 m/s (200 to 250 fpm). In order to minimize the pressure loss and maximize the airflow, the filter area may exceed the coil area.

A similar application of the invention can be added to outdoor condensing units for large walk-in coolers, reach-in refrigerators, beer coolers, or for any heat exchanger rejecting heat to an airstream.

The filter can also be used in conjunction with a misting system. Applicant has previously disclosed details of arranging mister nozzles on a post in Jensen. These may be used with a series of baffles to reduce the turbulence in the immediate area around the air conditioning unit.

The mister nozzles may also be brought inside of the condenser filters by adding a second layer of filter on or very near the condenser coil. In this manner the condenser airflow will first be filtered for grease and debris, then the cleaner air will have mist evaporated—dropping its temperature, and the cleaner and cooler air will pass through the second filter to capture any unevaporated mist (as in Jensen), and finally pass through the condenser coil. Since the inner filter's primary purpose is to capture unevaporated mist, it should be made of fiberglass. The glass fibers are hydrophilic and are extraordinarily effective at keeping mist from reaching the condenser coil.

Figure 2:
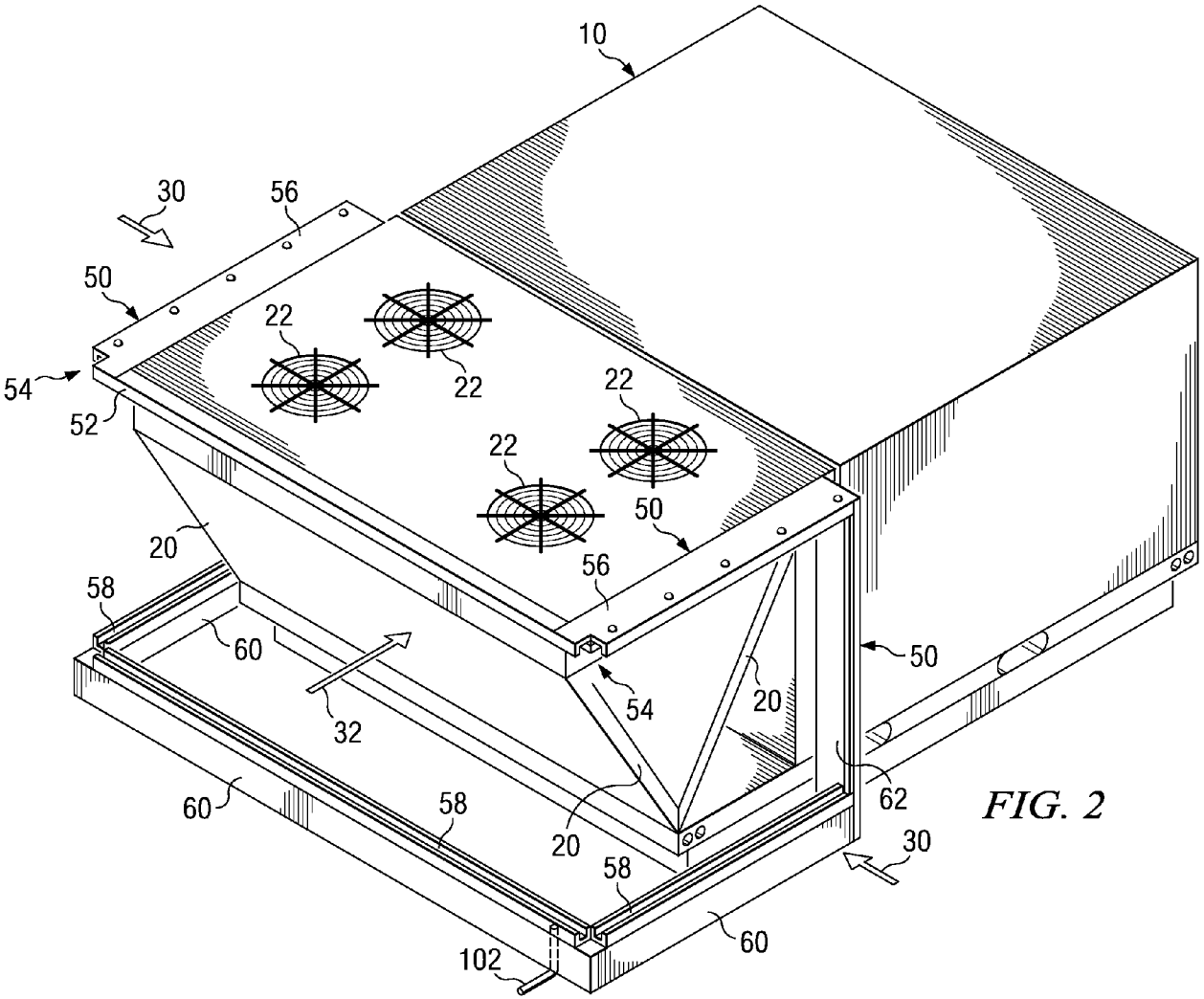
FIG. 2 is a perspective view an air conditioning unit employing a filter rack assembly filtering, shown filters removed from the filter rack assembly.

Referring now to FIG. 2, one embodiment of the invention is shown. It is an isometric view of a rooftop air conditioning unit. The rooftop unit 10 may represent a 15-ton Lennox unit that is often found on restaurants, retail stores, and other commercial roofs. It has a unique configuration of two angled condenser coils. This requires some additional design consideration that is not necessary with a rooftop unit that has vertical coils. The differences will be pointed out. The filter rack assembly is shown without filters or misters for clarity.

The rooftop unit 10 has four condenser fans 22 that draw ambient or outdoor air through the condenser coils 20. Heat from the air conditioned space is rejected to this outside air flow which is discharged up through the fan opening. The portion of the rooftop unit 10 that does not have coil is occupied by the compressors, the evaporator and indoor fan, and the power controls. They are not shown for clarity.

Air enters the back coil through the triangular openings 30 on each side. And air enters the front coil through the exposed face 32. Because the triangular openings 30 have less area than the coil itself, the air velocity will be relatively higher.

A filter rack assembly 50 is also shown and is configured to envelope the coils 20. It is comprised of three upper channels 52, 54 and three lower channels 58. The upper channel 52 extends longitudinally across the front of the unit and may be attached directly to the rooftop unit 10. As used herein, expressions such as "longitudinal," "transverse," "horizontal," and other expressions of orientation are used for ease of description for the system shown, and are not intended to be construed in any limiting sense. The two opposite side channels 54 extend transversely and are offset from the ends of the rooftop unit 10 a longitudinal distance to create a plenum space for additional filtered air to get from the front of the unit to the triangular openings 30. The offset to side channels 54 is created by the horizontal panels 56, which are attached to the rooftop unit 10 and the channels 54.

The three lower channels 58 are similar in configuration and align with the channels 52, 54 described above and are supported on the roof by curb 60 or other support surface. The channels 52, 54, 58 are arranged to allow the filters to slide in and out for quick and easy replacement. There is also a vertical back panel 62 on each side of the rooftop unit 10. The purpose of these panels 62 is to prevent unfiltered air from bypassing the filter and entering the coils 20. The lower channels 58 can also serve as a drain channel.

Figure 3:
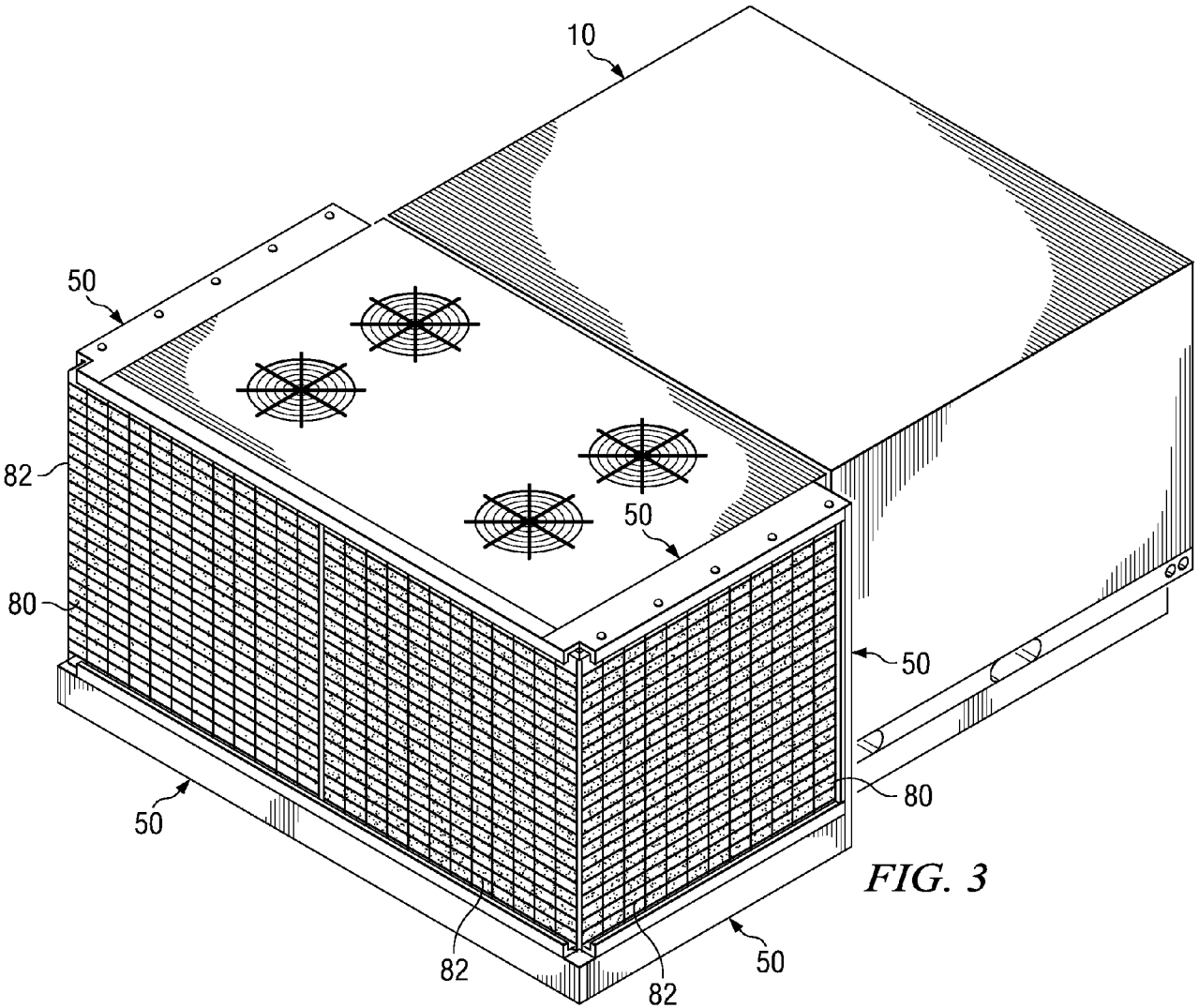
FIG. 3 is the air conditioning unit of FIG. 2, with filters installed with the filter rack assembly.

Referring to filter elements 80 in FIG. 3, the filter elements 80 are provided that are received within the channels. One function of the filter is to capture the larger droplets of mist that have not fully evaporated and keep them from reaching the hot condenser coil where they would deposit or leave behind minerals, when the system is used with a misting system. When these droplets contact the filter, many droplets continue to evaporate. The largest droplets, however, may collect and eventually trickle or fall to the bottom of the filter and into the channels 58. This water runoff can be drained away to either a roof drain or the unit's 10 condensate drain via a drain pipe 102 (FIG. 2).

FIG. 3 is an isometric view similar to that of FIG. 2. In FIG. 3, the filter rack assembly 50 is shown with the filters elements 80 installed. In this embodiment the filters may be cut from a 1" thick fiberglass filter roll. They are inserted in a PVC coated wire mesh 82 which holds the filter in place and that may slide easily into the channels. Such filters for a 15-ton unit are readily managed by a single maintenance worker. For a 15-ton Lennox unit, as has been described, a total filter area is about 72 $ft^2$ whereas the total coil area is 56.5 $ft^2$. The filter area may exceed the coil area by 10% or more so that it will have low pressure loss and be able to fill partially with grease and debris without losing its effectiveness.

Grease, dirt, or debris collected by the filters may be readily visible to indicate that the filters should be replaced or cleaned. Additionally, the pressure drop across the filter may be monitored, such as through a pressure differential sensor, and a remote signal can indicate the need for maintenance. A maintenance worker may pull the filter sections 80 out and then pull out the dirty filter from the mesh to discard it. A clean filter may then be inserted into the mesh 82 and the assembly slid back into the rack 50 (see FIG. 6). Alternately, the filters may be smaller units as described in FIG. 7.

The filters may need to be replaced as often as once or twice per month on restaurants that prepare greasy foods, such as fried chicken, grilled beef, etc. Although frequent, this takes significantly less effort than cleaning the coils monthly or bi-monthly. The cooling capacity will be increased and since a restaurant rooftop unit can run for 16-plus hours per day and seven days per week, the annual energy savings can reach 10,000 kWh for a typical 15-ton unit in a warm climate. Additional performance improvement can be obtained by adding the misting system.

For conventional rooftop units and condensing units with vertical condenser coils, the horizontal offset panels 56 and the air plenum they create may not be used since there is generally a uniform velocity across all of the condenser coil surface(s). However, the offset and the plenum that is created is useful for the embodiment of the invention with mister posts positioned inside the prefilter, as is described below with respect to FIG. 4.

Figure 4:
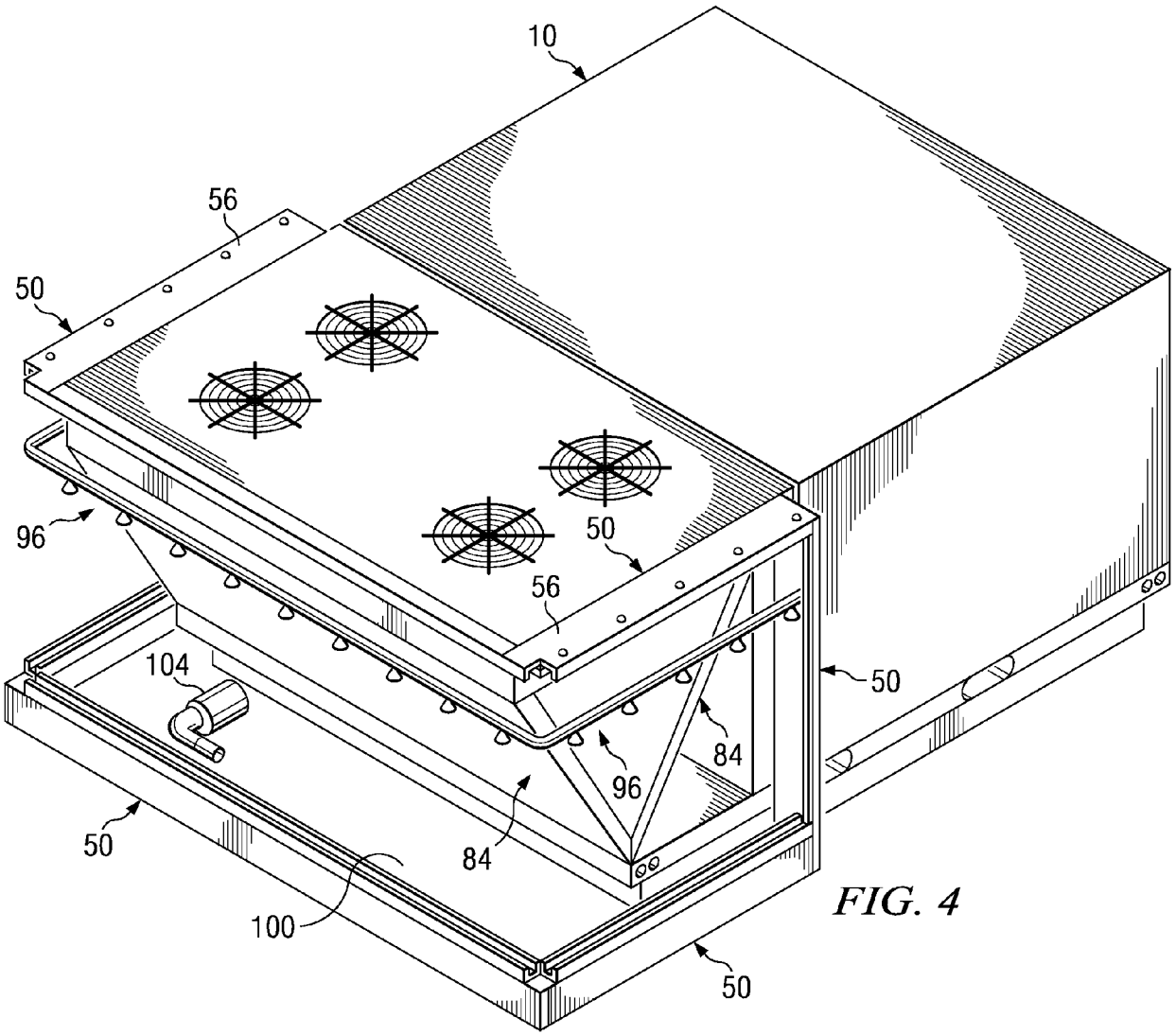
FIG. 4 is a perspective view an air conditioning unit employing both a filtering and misting system, shown with filters removed from a filter rack assembly of the filtering system.

The embodiment of FIG. 4 is similar to that of FIG. 2 except that includes a misting system. In this embodiment, the mister nozzles 96 are added within the plenum created by the filter system 50. Please note that the filters are shown removed to reveal the plenum area. The operating principal is similar, except that the condenser air is first filtered to remove grease and contaminants, then water is discharged for evaporation within the plenum causing the temperature to drop as the airflow approaches saturation, 100% r.h. This arrangement allows the prefilter to settle the airflow within, insuring that virtually all the mist cooled air reaches the condenser coil. Because some of the unevaporated mist could now reach the coil, a second filter 84 is attached adjacent to the coil.

In moderately humid climates, and those that are more humid, the misting system may still increase the air conditioning unit's efficiency greatly. However, there may be more days when the water runoff will be high enough to make capturing it desirable. A drain pan 100 can be provided, which may be made from galvanized steel or from molded plastic similar to that which is sprayed into pick-up truck beds. Other materials may be used as well. It may be mounted to roof curb or other support and generally follow the natural slope of the roof. A drain tube or pipe 102 can be placed at the low point. This would typically be routed to a roof drain. Or a small condensate pump 104 can be added to pressurize and supply the water runoff to another mister post 98, independent of the other misters 96, thereby allowing very little water to be wasted. In such instances, the drain pipe 102 would serve only as a secondary or emergency drain.

Figure 5:
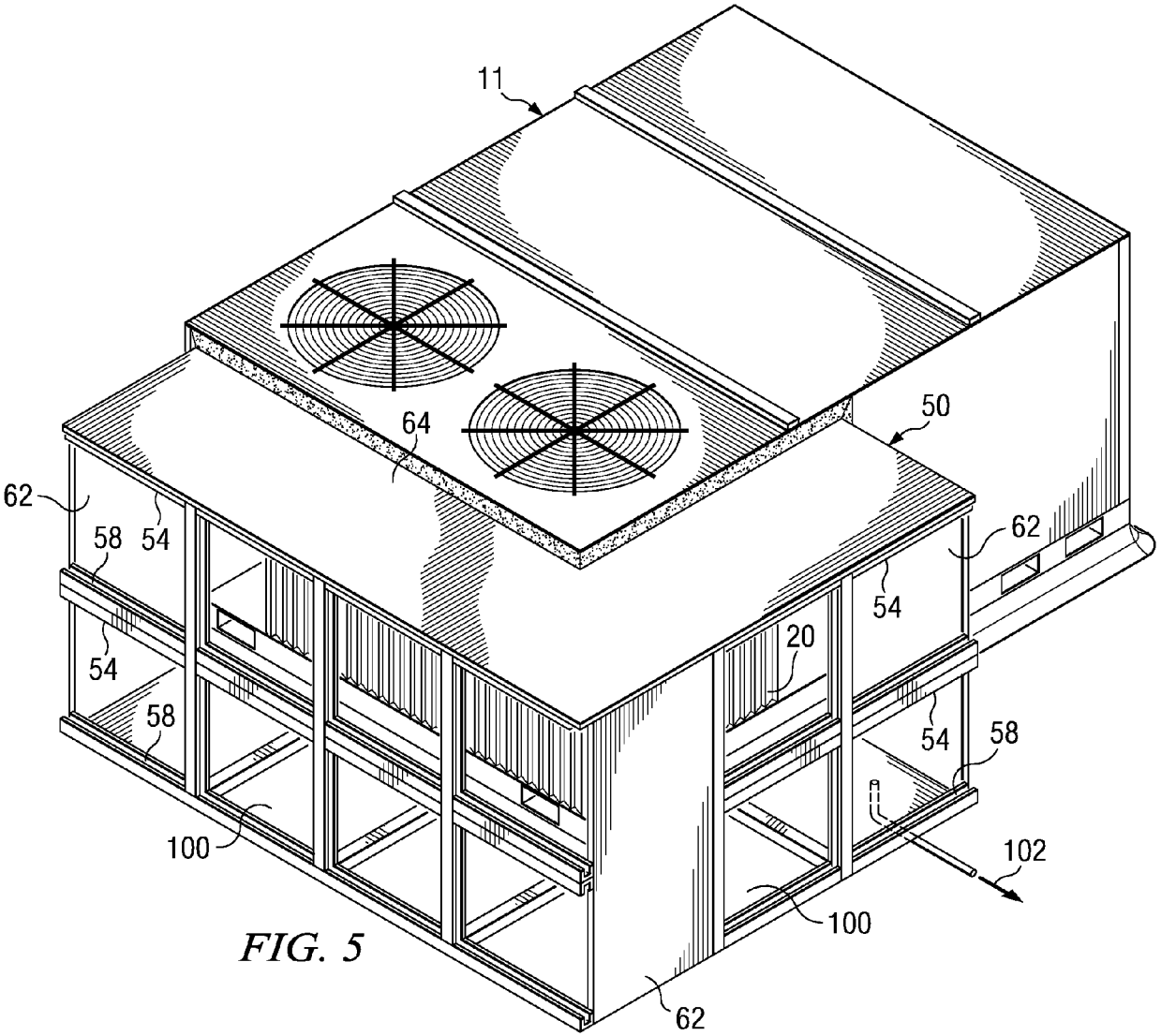
FIG. 5 is a perspective view an air conditioning unit with vertically oriented condenser coils and employing a filter rack assembly, shown with the filters removed from the filter rack assembly.

The embodiment of FIG. 5 is similar to that of FIG. 4, except that the rooftop air conditioning unit 11 is typical of those with vertical condenser coils 20. An example of a commercially available rooftop unit, such as the unit 11, may be a Trane 25-ton unit. The filter rack assembly 50 is somewhat deeper, typically 24" to 36" to allow for the majority of the mist to evaporate as it travels toward the inner filter (not shown for clarity). In this embodiment, there are two sets of channels for each set of top and bottom filters. The upper channels 54 may be made deeper than the lower channels 58 to allow maintenance personnel to insert filter sections by pushing them all the way into channel 54 and sliding the bottom over and into the lower channel 58. Then the filter can be dropped into channel 58 and held securely in place. This method is commonly employed in a number of air handling units and allows for the use of multiple smaller, more manageable filters. It also allows the large filter rack 50 to be fabricated and transported to the site in smaller, modular pieces.

The channels 54 and 58, as shown, are for the outer filters. A similar set of channels is fabricated on the inside, nearer the coil 20, for holding the inner filters. The vertical panels 62 may be made from sheet metal or from acrylic or polycarbonate sheet for easy visual inspection if desired.

The filter rack assembly may also be fabricated with a sheet metal top 64 or similar device to insure that substantially all the air that enters the condenser coils 20 must first pass through the outer and then the inner filters. The bottom 100 not only serves a similar purpose to top 64, but may also serve as a drain pan for water runoff. The water runoff may be drained at a low point and conducted via drain pipe 102 to a condensate drain, roof drain, or to a supplementary pump, as was shown in FIG. 4.

In the embodiments of either FIG. 4 or 5 it would also be possible to pump condensate from the evaporator coil which is typically also just drained away. This cold condensate would supplement the water runoff from the main nozzles and maximize the use of available water by diverting the drainage water and remisting all of it through the independent mister nozzles 98, as shown in FIG. 4.

It would also be possible to combine the drainage water (condensate and mist runoff) with the supply water and pump the combination to a very high pressure, greater than 500 p.s.i., as compared to the typical city delivery pressure of 60 to 80 p.s.i. This creates a fog or cloud of smaller water droplets than the mist created at city water pressure. The substantial increase in water surface area may improve the evaporation and saturation effectiveness enough to compensate for the additional pump power consumed.

Figure 6:
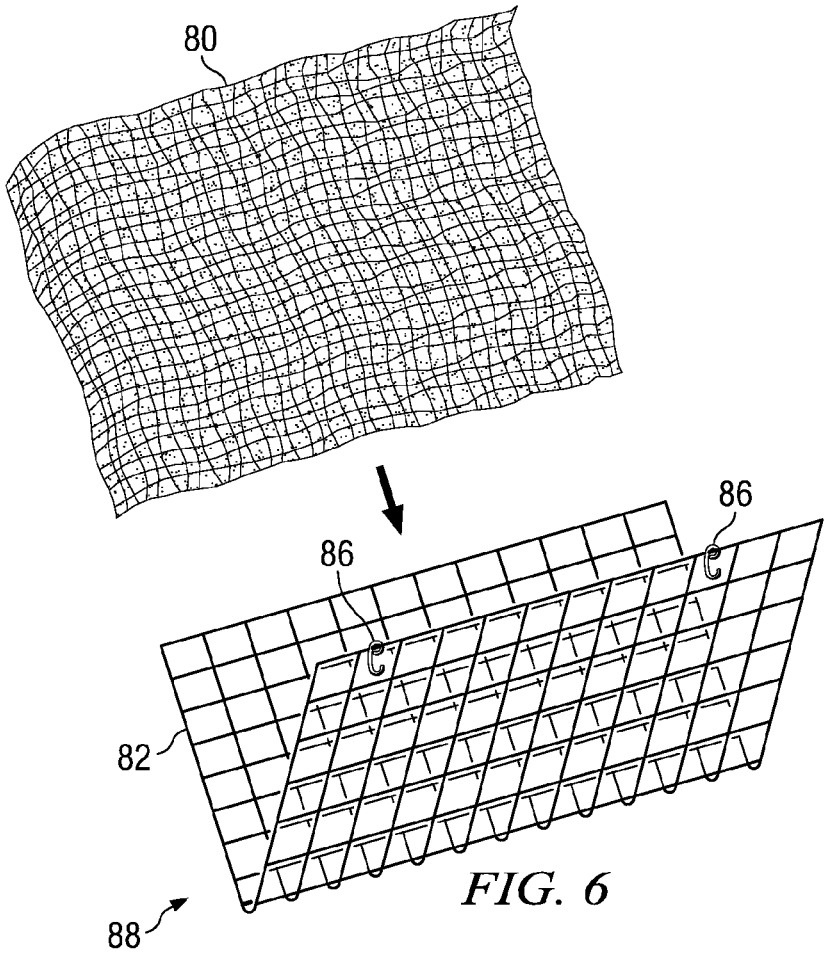
FIG. 6 is a perspective view of a frame of the filter element, shown with filter material exploded from the frame.

FIG. 6 is a partial isometric view of a wire mesh frame 82 and how the filter material 80 can be dropped into it. Fiberglass may work well for the filter material 80 since it is inexpensive, can be cut to size, has low pressure drop, and captures grease, mist, and other debris well. The filter may optionally be secured to the frame 82 through adhesive or glue. The fiberglass filter material may be non-washable and disposable. The filter material may also be washable. The wire mesh 82 can be either galvanized steel wire, PVC coated wire, or a similar non-corrosive and rigid material. It can also be cut to size for a given air conditioning unit, but can be reused with replacement filters. Clips or fasteners 86 may be used for attaching the two sides together, sandwiching the filter between. The bottom of the mesh 88 may be bent with a small radius to allow the filter 80 to drop all the way in and make for easier insertion and removal from filter rack 50 (not shown in this view). It would also be possible to standardize on a variety of sizes of filters from the filter manufacturers and use them directly with additional support means. Other configurations may be used for the filter and filter frame as well.

Figure 7:
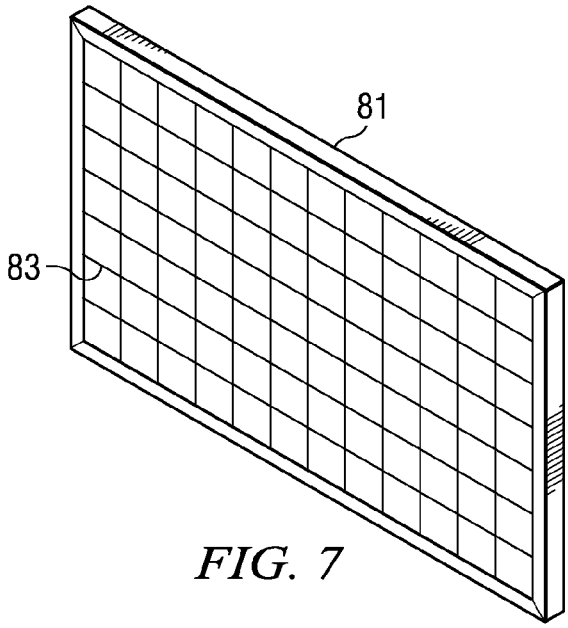
FIG. 7 is a perspective view of a frame for a modular filter element.

FIG. 7 shows smaller modular filters that are completely discardable and reduce the maintenance even further. They may be fabricated in standard sizes with plastic, aluminum, or similar water-resistant frame 81 and scrim 83. Scrim 83 is a rigid or semi-rigid mesh or net that gives support to the filter material (not shown in this figure). Another possibility is for the scrim 83 to be partially melted (if plastic) or otherwise glued or adhered directly to the filter, allowing the filter frame 81 to be eliminated. This will improve the drainage of water runoff from the filter and also reduce its cost. A third method would be to weave or thread a nylon cord or string into the fiberglass filter roll. This would allow for easy trimming of the filter and using the cord to tie the filter to the condensing unit.

Figure 8:
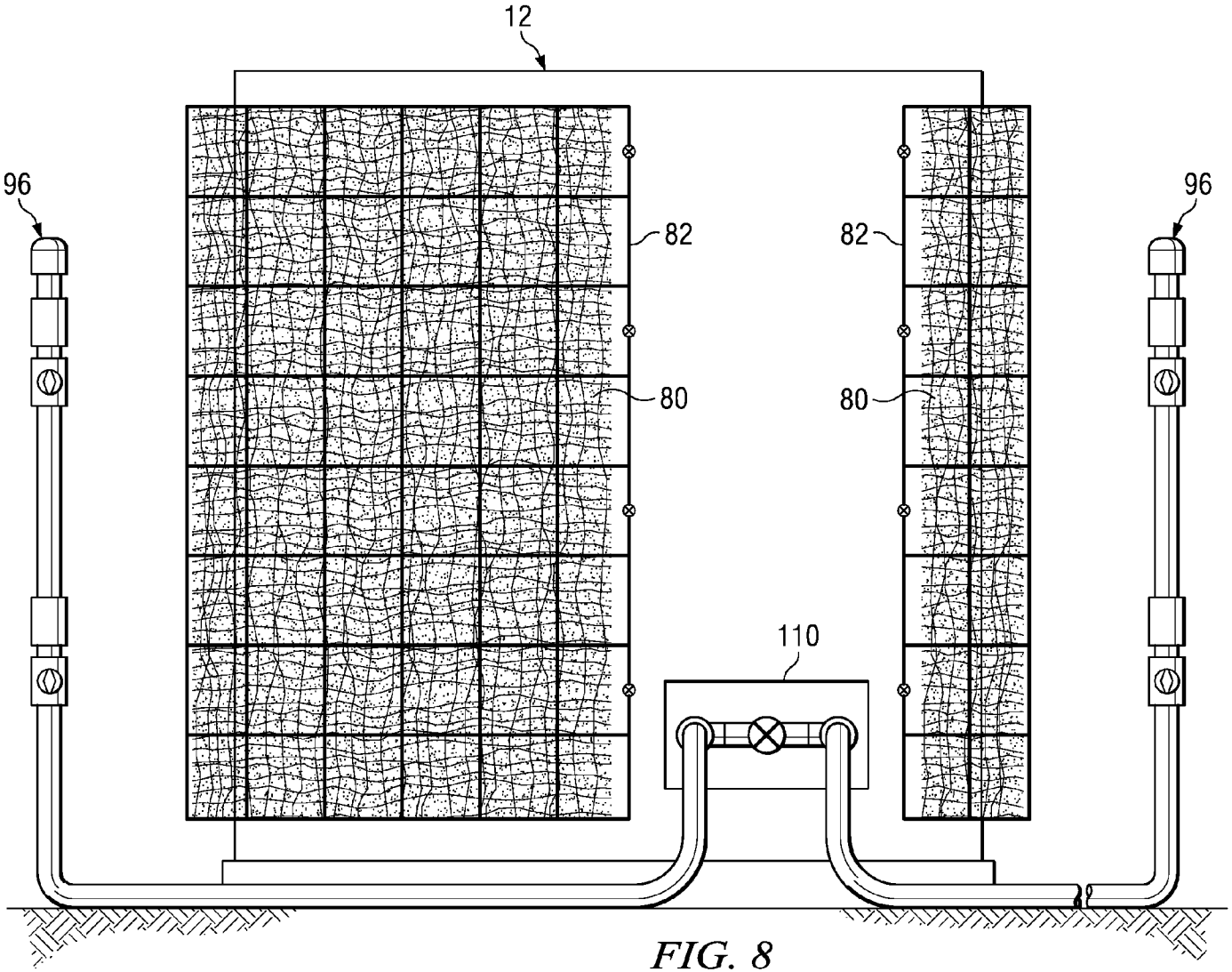
FIG. 8 is a front elevational view of a residential-type air conditioning unit employing a mister and filter system with filter material being held in place by a mesh element.

FIG. 8 shows a front view of a residential type split-system condensing unit 12. It shows the smaller mister posts 96 such as disclosed in Applicant's pending U.S. patent application Ser. No. 11/043,763. The filter 80 could be held in place by wire mesh similar to that described for FIGS. 2 through 7. A flexible, plastic mesh 82 that can be cut to size and attached to the condensing unit 12 may also be used. For added convenience, the filter and mesh may be glued or adhered together so that user just trims and attaches the assembly. The filter and mesh housing may be hung by pins, hooks or other fasteners directly to the air conditioning unit. A mist controller 110 that may be used that uses no electrical power is a pressure regulated water valve. It may attach with a Schrader valve to the condensing unit's high pressure (liquid) refrigerant line at the service port. This will sense the compressor's discharge pressure. When the unit is running and it is sufficiently hot (e.g. 90° F. adjustable), the spring loaded valve will open and allow water to flow to the misters. When the unit cycles off, the pressure will drop and the water valve will close.

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

I claim

1. A method of transferring heat comprising:

providing heat exchanger unit that is at least partially air cooled, the heat exchanger unit having an evaporator, condenser, compressor and a fan for forcing air over a heat exchange surface of the condenser;

positioning a prefilter filter element in an air stream directed to the heat exchange surface of the condenser for capturing at least one of grease, debris and other contaminants that are not entrained within any liquid cooling fluid that would otherwise contact the heat exchange surface, the prefilter filter element being spaced apart from the heat exchange surface to define a plenum;

allowing the filter element to capture the at least one of grease, debris and other contaminants prior to contact with the heat exchange surface of the condenser;

providing a mist generator having at least one nozzle located between the prefilter filter element and the heat exchange surface of the condenser for directing a stream of fine mist or atomized liquid coolant into the air within the plenum between the prefilter filter element and the heat exchange surface of the condenser, the mist generator being coupled to a supply of liquid coolant; and controlling the degree of mist or atomized coolant generated by the mist generator with a controller.

2. The method of claim 1, further comprising:

positioning a second filter element between the at least one nozzle and the heat exchange surface for capturing droplets of liquid coolant, the at least one nozzle being spaced apart from the filter elements;

and directing the stream of mist or atomized liquid coolant directly into the air between the first prefilter and second filter elements.

3. The method of claim 1, wherein:

the filter element effectively surrounds the heat exchange surface of the condenser so that substantially no non-filtered air contacts the heat exchange surface.

4. The method of claim 1, wherein:

the filter element exhibits a pressure loss of from about 15 to about 25 Pa at a face velocity of from about 1 to 1.25 m/s.

5. The method of claim 1, wherein:

the filter element is a non-woven fiberglass filter element.

6. The method of claim 1, wherein:

the filter element is formed from a hydrophilic material.

7. The method of claim 1, wherein:

the filter element has a thickness of from 1 inch or more.

8. The method of claim 1, wherein:

the condenser is positioned at a location wherein exhaust from a kitchen exhaust fan comes into contact with the filter element.

9. The method of claim 1, wherein:

the fan of the heat exchanger is used to draw air through the condenser coils.

10. The method of claim 1, further comprising:

positioning a second filter element between the at least one nozzle and the heat exchange surface for capturing droplets of liquid coolant, the at least one nozzle being spaced apart from the filter element;

and directing the stream of mist or atomized liquid coolant directly into the air between the first and second elements.

11. The method of claim 1, wherein the filter element comprises:

a filter frame attached to or supported by the heat exchanger unit;

a filter housing that secures to the frame, and a replaceable or washable filter media that is housed within the filter housing.

12. The method of claim 11, wherein:

the filter frame includes channels or flanges for supporting the filter housing.

13. The method of claim 11, wherein:

the filter frame includes fasteners for fastening the filter element to the heat exchange unit.

14. The method of claim 11, wherein:

the filter housing includes a generally rigid mesh panel against which the filter media abuts that allows air to pass therethrough.

15. The method of claim 1, further comprising:

providing a sensor for monitoring the pressure differential across the filter element.

16. The method of claim 1, wherein:

the filter element has a MERV rating of from 1 to 4.

17. A method of transferring heat comprising:

providing heat exchanger unit that is at least partially air cooled, the heat exchanger unit having an evaporator, condenser, compressor and a fan for forcing air over a heat exchange surface of the condenser;

positioning a first fiberglass prefilter filter element having a MERV rating of from 1 to 4 in an air stream directed to the heat exchange surface of the condenser for capturing at least one of grease, debris and other contaminants that are not entrained within any liquid cooling fluid that would otherwise contact the heat exchange surface;

positioning a second fiberglass filter element adjacent to the heat exchange surface with the second filter element locating between the first prefilter filter element and the heat exchange surface, the first and second filter elements being spaced apart from one another to define a plenum therebetween; and providing a mist generator having at least one nozzle for directing a stream of fine mist or atomized liquid coolant into the air within the plenum between the filter elements, the mist generator being coupled to a supply of liquid coolant;

controlling the degree of mist or atomized coolant generated by the mist generator with a controller;

allowing the first filter element to capture the at least one of grease, debris and other contaminants prior to entering the plenum;

and directing the stream of mist or atomized liquid coolant directly into the air within the plenum defined between the first and second filter elements.

18. The method of claim 17, wherein the filter element comprises:

a filter frame attached to or supported by the heat exchanger unit;

a filter housing that secures to the frame, and a replaceable or washable filter media that is housed within the filter housing.

19. The method of claim 18, wherein:

the filter frame includes channels or flanges for supporting the filter housing.

20. The method of claim 18, wherein:

the filter frame includes fasteners for fastening the filter element to the heat exchange unit.

* * * * *